US010363451B2

(12) United States Patent
Porteros De Luz

(10) Patent No.: US 10,363,451 B2
(45) Date of Patent: Jul. 30, 2019

(54) CROSS-TRAINING TREADMILL

(71) Applicant: Veronica Porteros De Luz, Dewinton (CA)

(72) Inventor: Veronica Porteros De Luz, Dewinton (CA)

( * ) Notice: Subject to any disclaimer, the term of this patent is extended or adjusted under 35 U.S.C. 154(b) by 0 days.

(21) Appl. No.: 15/425,862

(22) Filed: Feb. 6, 2017

(65) Prior Publication Data

US 2017/0144014 A1 May 25, 2017

Related U.S. Application Data

(63) Continuation-in-part of application No. PCT/IB2015/055922, filed on Aug. 4, 2015.

(60) Provisional application No. 61/999,656, filed on Aug. 4, 2014.

(51) Int. Cl.

| | |
|---|---|
| ***A63B 22/02*** | (2006.01) |
| ***A63B 69/00*** | (2006.01) |
| ***A63B 22/00*** | (2006.01) |
| ***A63B 21/062*** | (2006.01) |
| ***A63B 24/00*** | (2006.01) |
| *A63B 21/00* | (2006.01) |
| *A63B 71/00* | (2006.01) |
| *A63B 71/06* | (2006.01) |

(52) U.S. Cl.

CPC ..... *A63B 22/0235* (2013.01); *A63B 21/0628* (2015.10); *A63B 21/154* (2013.01); *A63B 21/4027* (2015.10); *A63B 22/0012* (2013.01); *A63B 22/0023* (2013.01); *A63B 24/0087* (2013.01); *A63B 69/0064* (2013.01); *A63B 21/156* (2013.01); *A63B 21/4009* (2015.10); *A63B 22/0005* (2015.10); *A63B 71/0622* (2013.01); *A63B 2022/0278* (2013.01); *A63B 2071/0081* (2013.01); *A63B 2225/09* (2013.01); *A63B 2225/68* (2013.01)

(58) Field of Classification Search

CPC ..... A63B 22/2035; A63B 21/4027; A63B 24/0087; A63B 21/154; A63B 21/0628; A63B 22/0023; A63B 2022/0278

USPC ..... 482/5, 66

See application file for complete search history.

(56) References Cited

U.S. PATENT DOCUMENTS 4,625,962 A * 12/1986 Street ..... A63B 21/015 482/116
4,861,021 A * 8/1989 Edwards ..... A61H 3/008 482/54
5,951,449 A * 9/1999 Oppriecht ..... A63B 21/0087 482/103

(Continued)

*Primary Examiner* — Andrew S Lo

(57) ABSTRACT

An apparatus used for cardiovascular workouts and strength training workouts contains a treadmill, a first weight-engaging pulley mechanism, a second weight-engaging pulley mechanism, a first guide channel, and a second guide channel. The treadmill is used to complete the cardiovascular workouts. The first weight-engaging pulley mechanism and the second weight-engaging pulley mechanism are used for strength training. Since the weight arrangement of the apparatus is movable along the first guide channel and the second guide channel, the user can complete a wide variety of strength training workouts. The apparatus also contains an incline-adjustment mechanism, which orients the treadmill belt track to simulate an incline or a decline. A belt direction-reversing mechanism of the apparatus helps change the direction a belt that is layered along the treadmill belt track.

12 Claims, 8 Drawing Sheets

(56) References Cited

U.S. PATENT DOCUMENTS 6,126,575 A * 10/2000 Wang ..... A63B 22/0257 482/51
6,450,923 B1 * 9/2002 Vatti ..... A63B 21/00181 482/51
7,575,537 B2 * 8/2009 Ellis ..... A63B 21/00076 482/5
8,007,409 B2 * 8/2011 Ellis ..... A63B 21/0615 482/54
8,172,729 B2 * 5/2012 Ellis ..... A63B 21/4047 482/54
8,257,232 B2 * 9/2012 Albert ..... A63B 69/0064 482/54
2002/0010056 A1 * 1/2002 Borsheim ..... A61H 3/00 482/66
2005/0124471 A1 * 6/2005 Wilkinson ..... A63B 21/00065 482/121
2005/0239607 A1 * 10/2005 Chang ..... A63B 22/0023 482/54
2006/0281606 A1 * 12/2006 Radow ..... A63B 22/0235 482/54
2007/0232463 A1 * 10/2007 Wu ..... A63B 22/0257 482/94
2007/0287601 A1 * 12/2007 Burck ..... A63B 21/153 482/54
2009/0270226 A1 * 10/2009 Watterson ..... A63B 22/0023 482/4
2010/0113222 A1 * 5/2010 Radow ..... A63B 22/0235 482/5
2011/0082011 A1 * 4/2011 Ellis ..... A63B 21/0615 482/54
2011/0118090 A1 * 5/2011 Ellis ..... A63B 21/0615 482/54
2011/0281691 A1 * 11/2011 Ellis ..... A63B 22/0012 482/54
2011/0312474 A1 * 12/2011 Ellis ..... A63B 21/0615 482/54
2013/0184125 A1 * 7/2013 Maguire ..... A63B 22/02 482/54
2014/0087922 A1 * 3/2014 Bayerlein ..... A63B 22/0235 482/54
2015/0087484 A1 * 3/2015 Bayerlein ..... A63B 22/0235 482/54
2016/0008650 A1 * 1/2016 Jue ..... A63B 22/02 482/54
2016/0023049 A1 * 1/2016 Dalebout ..... A63B 22/0242 482/7

* cited by examiner

CROSS-TRAINING TREADMILL

The current application is a continuation-in-part of PCT application PCT/IB2015/055922 filed on Aug. 4, 2015 which claims benefit of U.S. provisional application Ser. No. 61/999,656 filed on Aug. 4, 2014. The current application is filed on Feb. 6, 2017 while Feb. 4, 2017 was on a weekend.

FIELD OF THE INVENTION

The present invention relates generally to training equipment. More specifically, the present invention introduces a treadmill that can be used for cross-training activities such as strength training.

BACKGROUND OF THE INVENTION

Individuals who intend to lose weight, prepare for an event, or in general achieve personal fitness goals engage in different forms of cardiovascular exercises. Walking and jogging are some of the most favored cardiovascular exercises among individuals of all ages. Since outdoor running and walking is not possible throughout the year, treadmills have a high demand among these users who prefer running or walking as a cardiovascular exercise.

Even though treadmills have numerous cardiovascular benefits, the effectiveness of the workout can be maximized by integrating strength training along with the cardiovascular workout. However, existing treadmills do not allow the user to engage in strength training and cardiovascular activities simultaneously. If the user prefers to incorporate strength training, the user needs to execute the strength training workout and the cardiovascular workout separately. As experienced by many individuals, the need to have two separate sessions for the cardiovascular workout and the strength training workout can be time consuming. Therefore, the need for a method that can combine both strength training and cardiovascular training is clear.

The lack of space is another issue that occurs when attempting to execute cardiovascular workouts and strength training exercises. Since the treadmill that is used for cardiovascular training and the weight equipment that is used for strength training need to be placed separately, a considerable amount of space is needed. Unless the individual has access to a health center, dedicating space for a treadmill and weight equipment may not always be practical.

The objective of the present invention is to address the aforementioned issues. In particular, the present invention is an apparatus that allows the user to obtain the benefits of treadmill training and also the benefits of strength training. In doing so, the present invention resolves issues such as the lack of time and the lack of space. Since the user can engage in cardiovascular training and strength training simultaneously, efficiency of the training session is maximized. On the other hand, since the weight equipment and the treadmill are available as a single unit, the issue of not having sufficient space is also resolved.

DETAIL DESCRIPTIONS OF THE INVENTION

All illustrations of the drawings are for the purpose of describing selected versions of the present invention and are not intended to limit the scope of the present invention.

The present invention introduces a single apparatus that allows the user to complete strength training workouts and cardiovascular training workouts. The effective design of the present invention allows the user to perform cardiovascular training and strength training simultaneously or separately. Therefore, the intensity and efficiency of a workout session can be maximized.

To complete the cardiovascular training aspect, the present invention utilizes a treadmill. On the other hand, to complete the strength training aspect, the present invention utilizes a movable weight arrangement. The movable weight arrangement can be positioned per user preference and per the workout executed by the user. Since the movable weight arrangement is moved along the length of the treadmill, multiple workouts can be completed with increased efficiency even in a restricted space.

Figure 1:
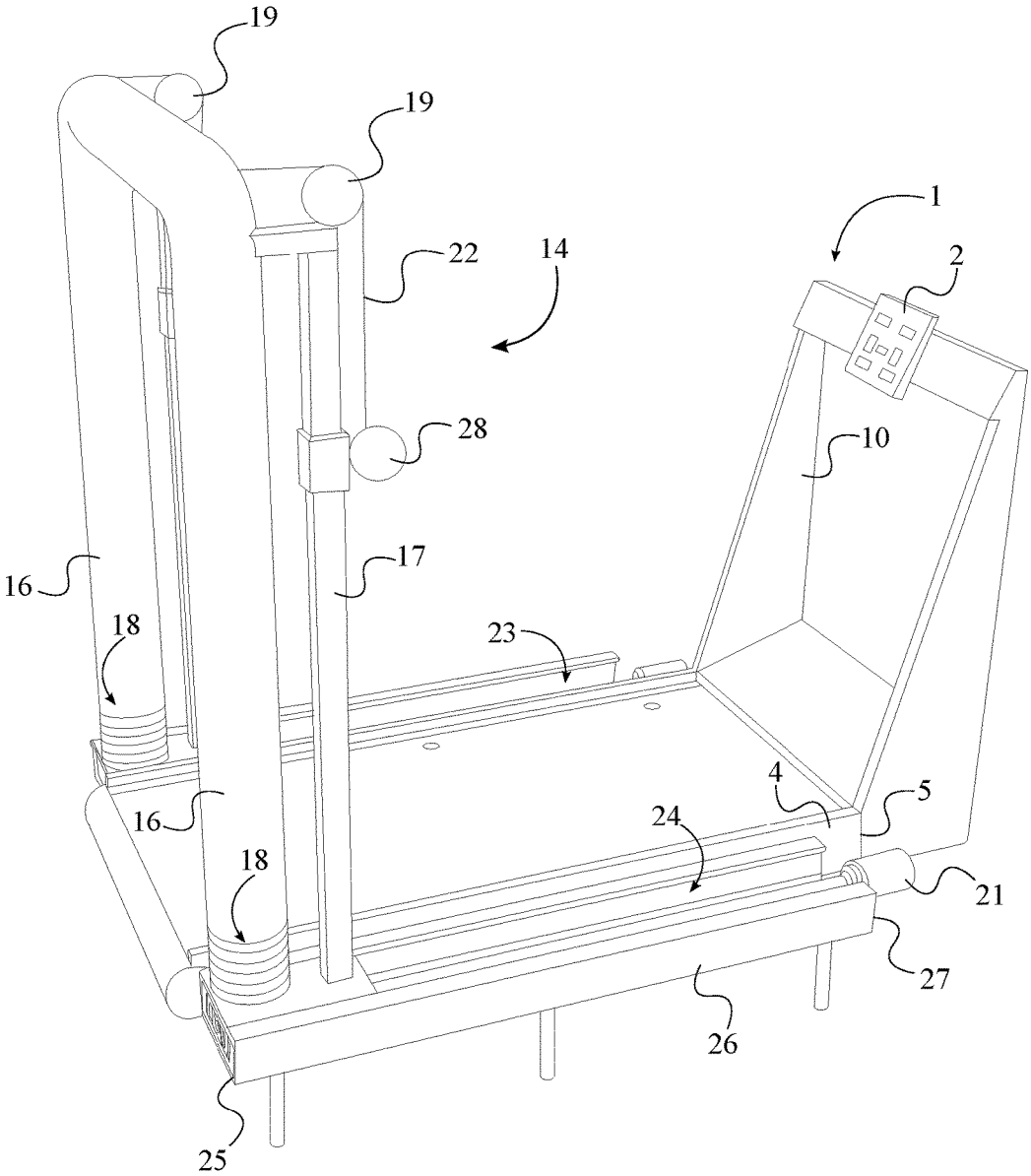
FIG. 1 is a perspective view of the present invention.
Figure 6:
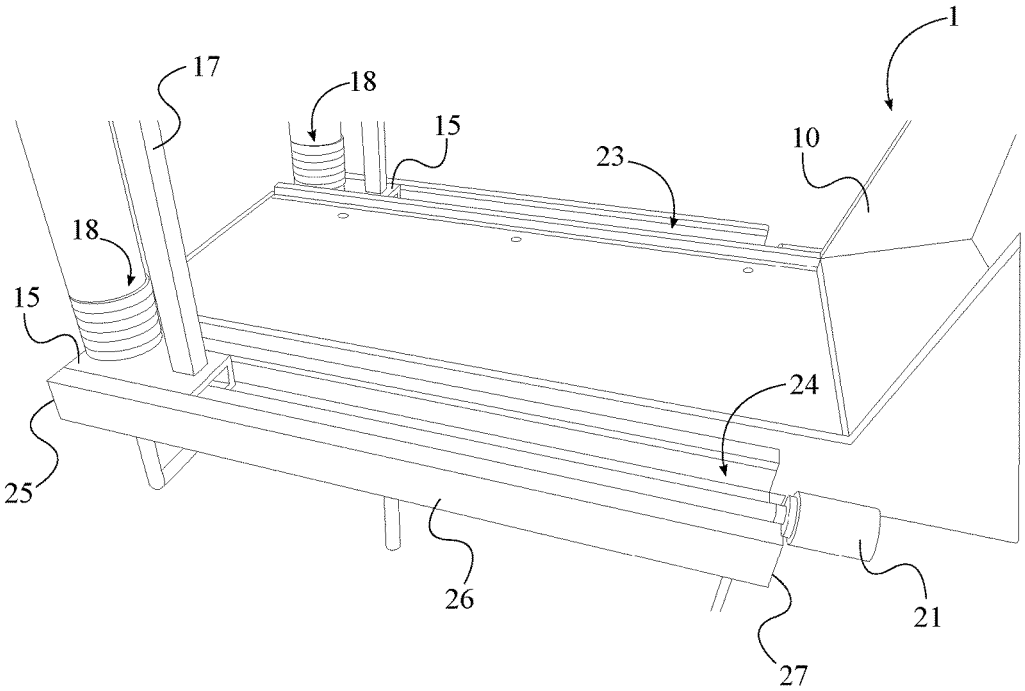
FIG. 6 is another perspective view of the present invention.

As illustrated in FIG. 1, the present invention comprises a treadmill 1, a first weight-engaging pulley mechanism 13, a second weight-engaging pulley mechanism 14, a first guide channel 23, and a second guide channel 24. As mentioned before, the treadmill 1 is used to execute any intended cardiovascular workout. The first weight-engaging pulley mechanism 13 and the second weight-engaging pulley mechanism 14 provide the user with the movable weight arrangement used for strength training workouts. The first guide channel 23 is used for moving the first weight-engaging pulley mechanism 13 along the treadmill 1. Similarly, the second guide channel 24 is used for moving the second weight-engaging pulley mechanism 14 along the treadmill 1. As seen in FIG. 6, the length of the first guide channel 23 and the second guide channel 24 determine the range in which the first weight-engaging pulley mechanism 13 and the second weight-engaging pulley mechanism 14 can be moved in.

Figure 5:
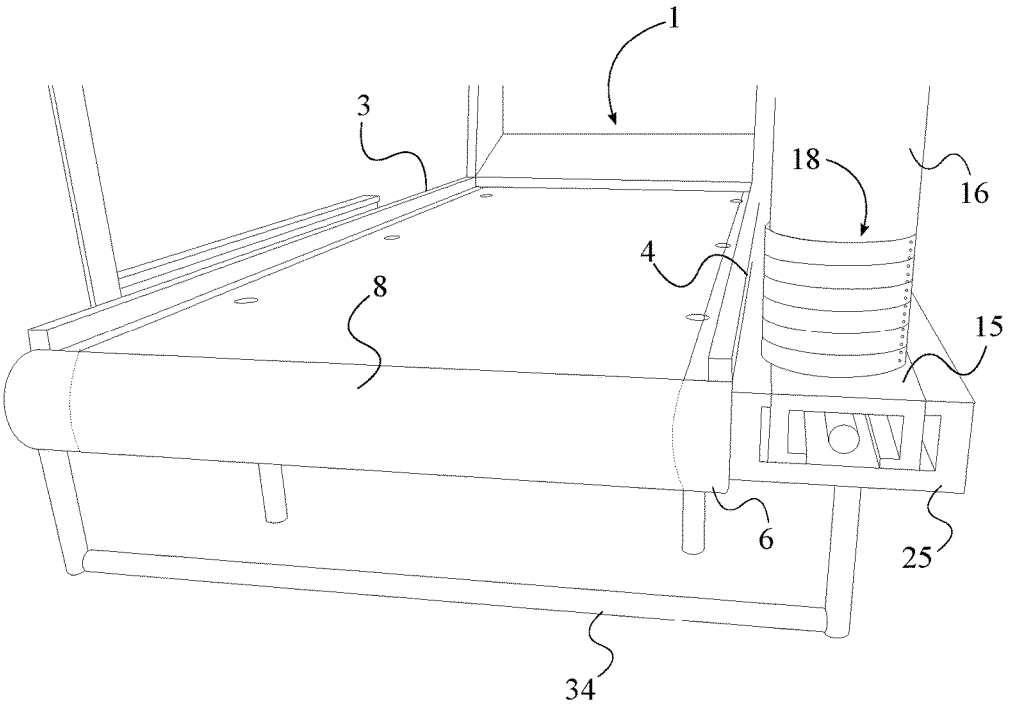
FIG. 5 is another rear view of the present invention.

As seen in FIG. 1 and FIG. 5, the treadmill 1 comprises a processing unit 2, a first lateral edge 3, a treadmill belt track 6, and a second lateral edge 4. The processing unit 2 is used to control functionalities of the treadmill 1 such as speed, incline, duration, type of cardiovascular workout, and direction. A width of the treadmill belt track 6, which is positioned in between the first lateral edge 3 and the second lateral edge 4, determines the overall width of the surface area that is being used for the workout. The first lateral edge 3 and the second lateral edge 4 determine the overall length of the treadmill 1.

Figure 3:
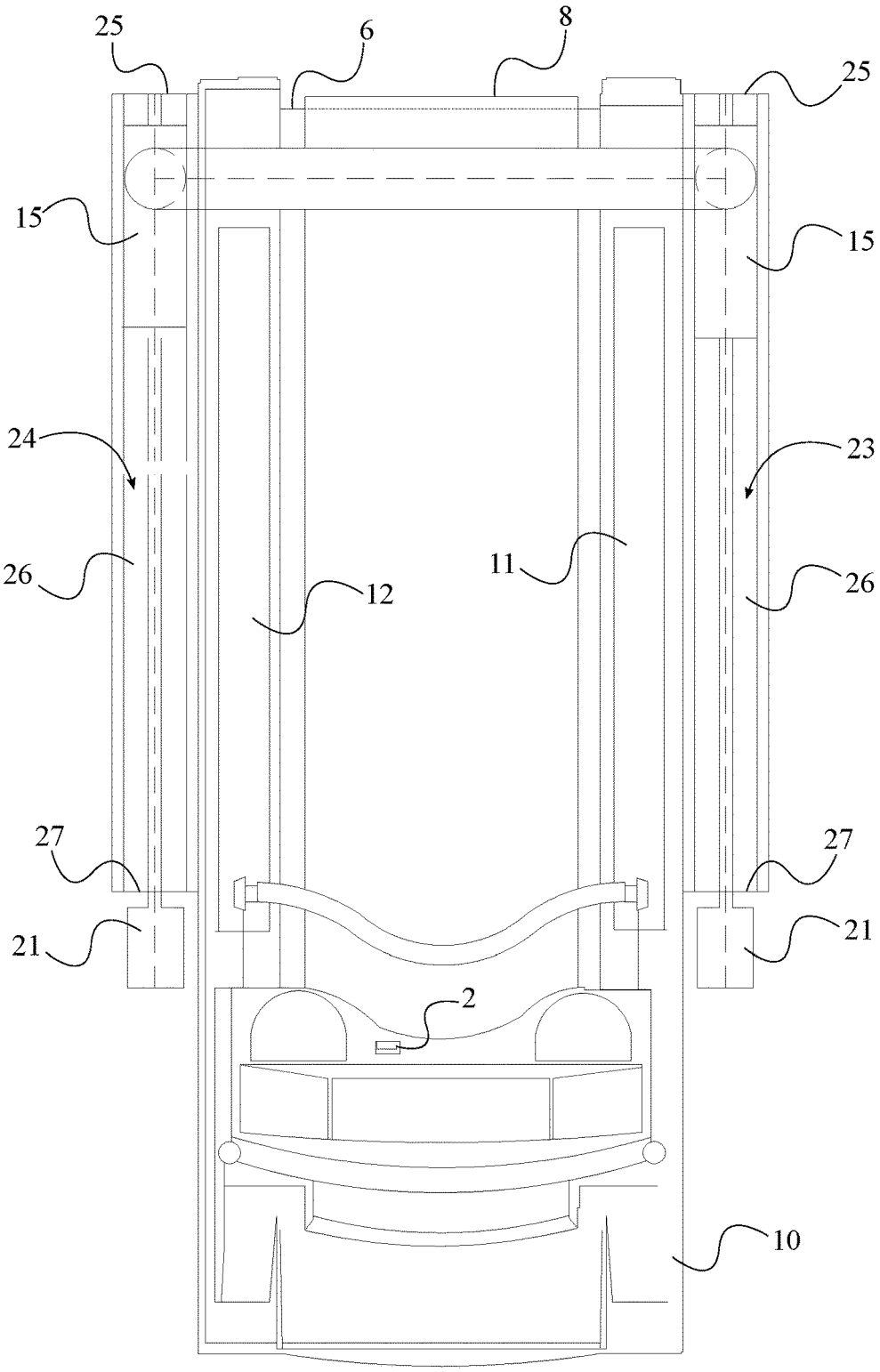
FIG. 3 is a top view of the present invention.

As seen in FIG. 3, for the first weight-engaging pulley mechanism 13 and the second weight-engaging pulley mechanism 14 to be movable, the first weight-engaging pulley mechanism 13 and the second weight-engaging pulley mechanism 14 each comprise a slidable base 15. The slidable base 15 of the first weight-engaging pulley mechanism 13 is slidably positioned along the first guide channel 23. Likewise, the slidable base 15 of the second weight-engaging pulley mechanism 14 is slidably positioned along the second guide channel 24 as seen in FIG. 6. Therefore, the first weight-engaging pulley mechanism 13 and the second weight-engaging pulley mechanism 14 can be moved along the first guide channel 23 and the second guide channel 24 simultaneously. As discussed before, to move the first weight-engaging pulley mechanism 13 along the treadmill 1, the first guide channel 23 is positioned adjacent and along the first lateral edge 3 and opposite the treadmill belt track 6. Similarly, the second guide channel 24 is positioned adjacent and along the second lateral edge 4 so that the second weight-engaging pulley mechanism 14 can be moved along the treadmill 1. The second guide channel 24 is also positioned opposite the treadmill belt track 6.

Figure 8:
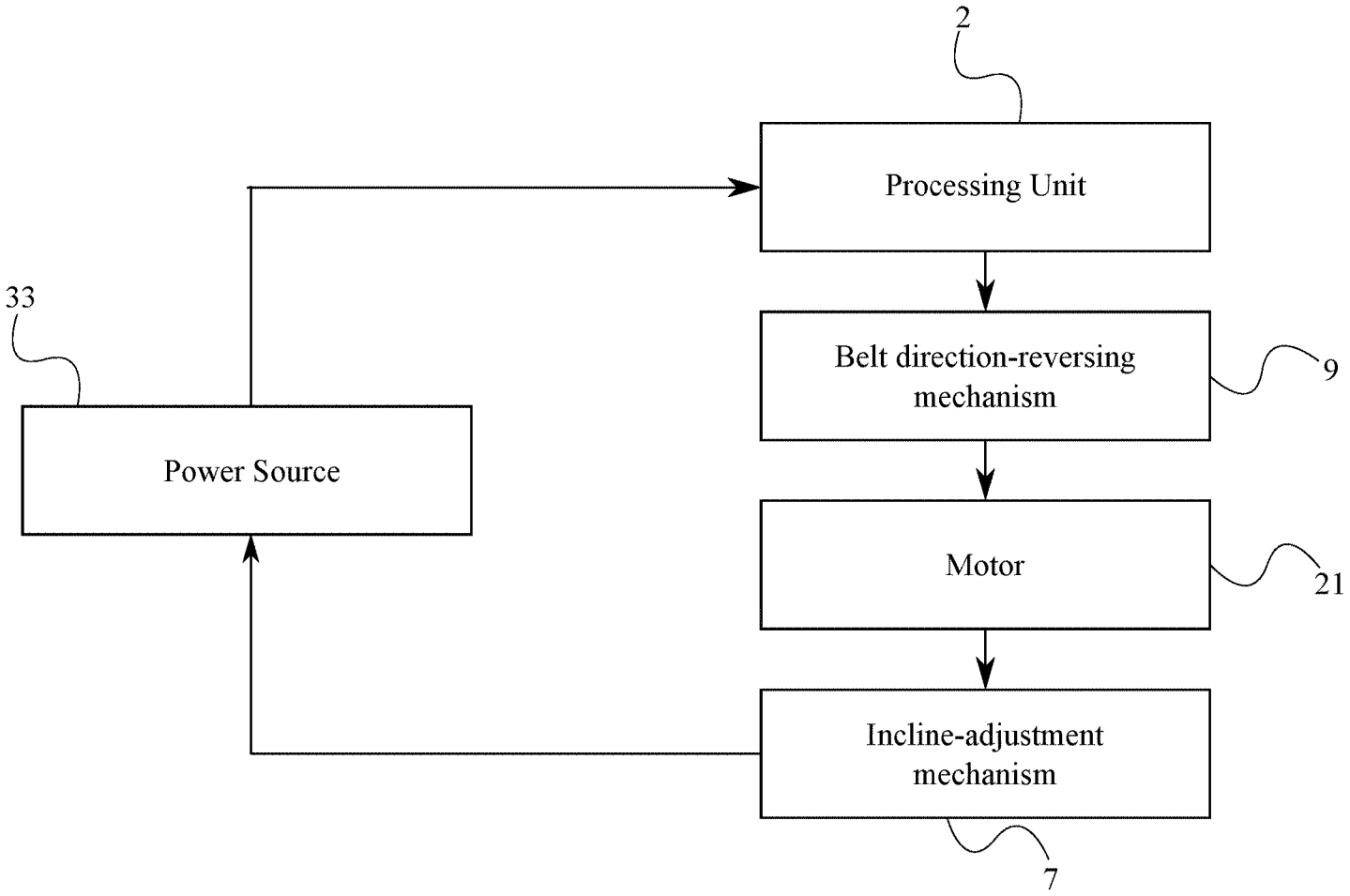
FIG. 8 is an illustration of the electronic connections of the present invention.

Similar to other existing treadmills, the treadmill 1 of the present invention is also powered through a power source 33 which can be, but is not limited to, a general-purpose alternating-current electric power supply. As illustrated in FIG. 8, to transmit electric power among all components of the present invention, the power source 33 is electrically connected to the processing unit 2.

Figure 2:
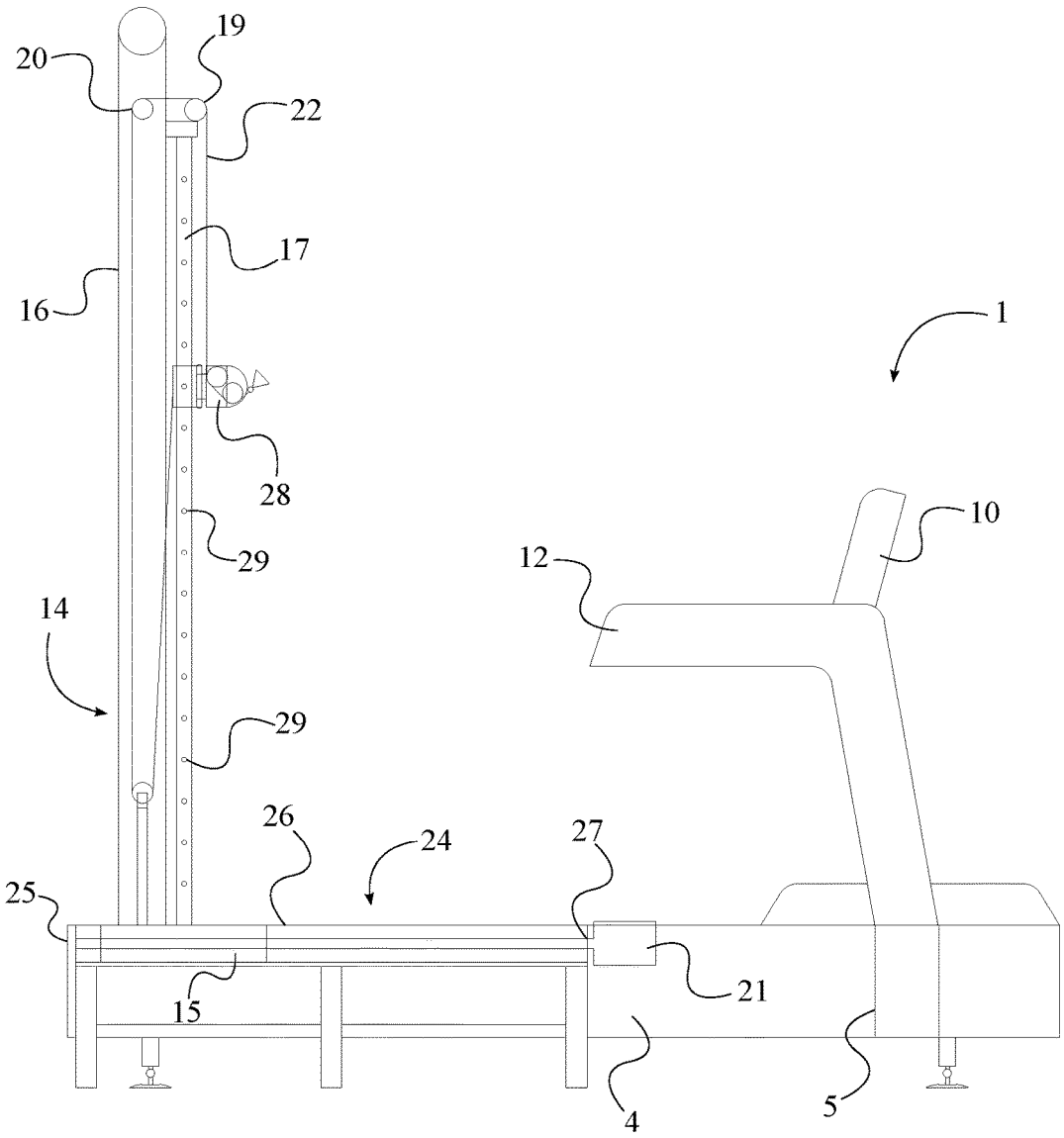
FIG. 2 is a side view of the present invention.

The first weight-engaging pulley mechanism 13 and the second weight-engaging pulley mechanism 14 need to be designed to be movable and fulfill the necessities of strength training. As seen in FIG. 2, the first weight-engaging pulley mechanism 13 and the second weight-engaging pulley mechanism 14 each further comprise a holding column 16, a guide pole 17, a set of weights 18, a first pulley 19, a second pulley 20, a motor 21, and a cable 22. The set of weights 18 is slidably positioned within the holding column 16. Since the set of weights 18 needs to be moved in a vertical direction, the holding column 16 is perpendicularly connected to the slidable base 15. The holding column 16 is appropriately designed to facilitate the slidable movement of the set of weights 18. In the preferred embodiment of the present invention, the holding column 16 is designed to be cylindrical. Therefore, the shape of each weight plate of the set of weights 18 is also designed to be cylindrical. However, in different embodiments of the present invention, the shape of the holding column 16 and the shape of each weight plate of the set of weights 18 can be different. Each weight plate of the set of weights 18 is stacked upon each other. Each weight plate of the set of weights 18 is identical so that the user can select a preferred weight from the set of weights 18. As an example, if each weight plate of the set of weights 18 weighs 5-pounds, and the user needs to select 25-pounds, five weight plates of the set of weights 18 are selected so that the preferred weight is obtained. In other words, the weight is indicated as increments of 5-pounds.

Figure 4:
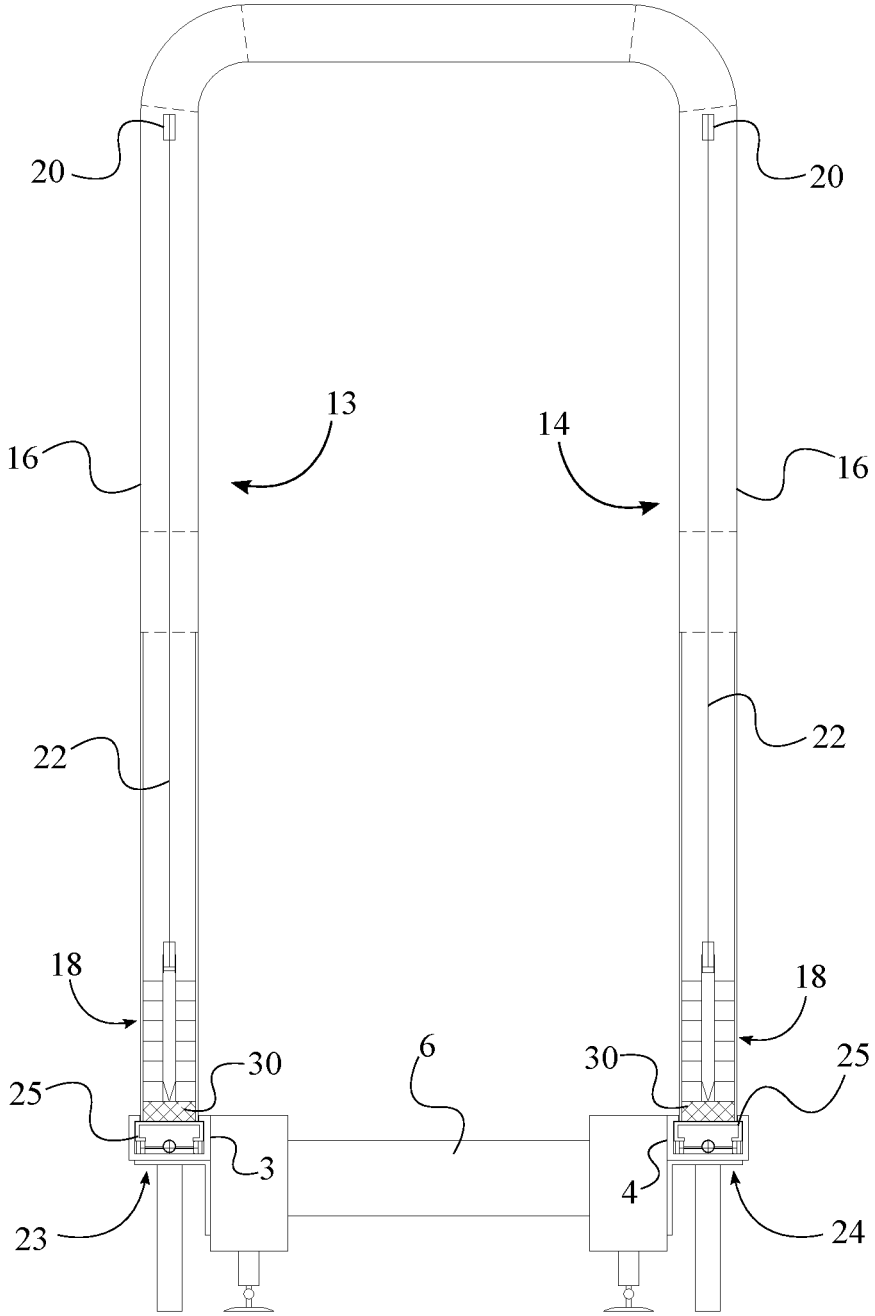
FIG. 4 is a rear view of the present invention.

The preferred weight can be selected differently in varying embodiments of the present inventions. As an example, a selection pin and a pin receiving bar can be used in one embodiment of the present invention. The pin receiving bar, which consists a plurality of equidistantly positioned pin receiving holes, perpendicularly traverses through the set of weights 18 as illustrated in FIG. 4. Each weight plate of the set of weights 18 also consists a pin receiving hole that is concentric with the plurality of pin receiving holes of the pin receiving bar. Therefore, when the user intends on selecting a preferred weight, the selection pin is inserted into the pin receiving hole of the weight plate from the set of weights 18. The selection pin is pushed through to the pin receiving hole from the pin receiving bar. Thus, the preferred weight is selected from the set of weights 18. Referring to the previous example, the selection pin is pushed into the pin receiving hole of the fifth weight plate from the set of weights 18. The selection pin will also be pushed into the pin receiving bar so that 5 weight plates from the set of weights 18 can be controlled by the user.

Since the set of weights 18 apply a considerable amount of pressure on the slidable base 15, the present invention further comprises a rubber damper 30 which is positioned within the holding column 16. Moreover, the rubber damper 30 is pressed against the slidable base 15 so that the force applied on the slidable base 15 by the set of weights 18 is minimized. As in FIG. 4, when the set of weights 18 is stationary, the rubber damper 30 is positioned in between the set of weights 18 and the slidable base 15.

When the preferred weight plate is selected, the preferred weight is controlled with the use of the cable 22. To do so, the cable 22 is mechanically engaged with the first pulley 19 and the second pulley 20 and terminally connected to the set of weights 18 opposite to the rubber damper 30. The first pulley 19 and the second pulley 20 are positioned appropriately to provide the necessary mechanical advantage for moving the set of weights 18. The guide pole 17 is used to position the first pulley 19 in a mechanically advantageous position. To do so, the guide pole 17 is positioned adjacent and parallel to the holding column 16. Similar to the holding column 16, the guide pole 17 is perpendicularly connected to the slidable base 15 so that the holding column 16 and the guide pole 17 move as a single unit along the first guide channel 23 and the second guide channel 24. The positioning of the guide pole 17 allows the first pulley 19 to be terminally connected to the guide pole 17 opposite to the slidable base 15. To correspond with the first pulley 19, the second pulley 20 is connected to the holding column 16 adjacent to the first pulley 19 and opposite to the slidable base 15.

The motor 21 of the first weight-engaging pulley mechanism 13 is used to move the first weight-engaging pulley mechanism 13 along the first guide channel 23. Likewise, the motor 21 of the second weight engaging pulley mechanism 14 is used to move the second weight-engaging pulley mechanism 14 along the second guide channel 24. To do so, the motor 21 is electrically connected to the power source 33. The first guide channel 23 and the second guide channel 24 each comprise a proximal end 25, a channel body 26, and a distal end 27. The channel body 26 extends from the proximal end 25 to the distal end 27. The channel body 26 also determines the range in which the first weight-engaging pulley mechanism 13 and the second weight-engaging pulley mechanism 14 can be moved in. The motor 21 is terminally connected to the distal end 27. Even though the motor 21 is used in the present invention, another comparable device or method can be used in a different embodiment of the present invention. Since the first weight-engaging pulley mechanism 13 and the second weight-engaging pulley mechanism 14 is positioned per user preference, the user needs to have control of the motor 21. To do so, the processing unit 2 is electronically connected to the motor 21.

For the first weight-engaging pulley mechanism 13 and the second weight-engaging pulley mechanism 14 to move together, the present invention further comprises a stabilizing arm 34 as shown in FIG. 5. The stabilizing arm 34 is connected to the channel body 26 opposite to the holding column 16 and the guide pole 17. Moreover, the stabilizing arm 34 extends from the slidable base 15 of the first weight-engaging pulley mechanism 13 to the slidable base 15 of the second weight-engaging pulley mechanism 14. The positioning of the stabilizing arm 34 allows the first weight-engaging pulley mechanism 13 and the second weight-engaging pulley mechanism 14 to move together along the first guide channel 23 and the second guide channel 24.

Different strength training exercises require the cable 22 to be oriented differently. To fulfill the need, the present invention comprises a mobile pulley 28. The mobile pulley 28 is slidably connected along the guide pole 17 so that the height and direction of the cable 22 can be adjusted as preferred. Knowing the exact height of the mobile pulley 28 is also necessary when completing strength training exercises. To fulfill the height requirement, the present invention further comprises a plurality of height-adjustment markers 29 which is distributed along the guide pole 17. The mobile pulley 28 is positioned at the preferred height along the guide pole 17 with the use of the height adjustment markers. Different interlocking mechanisms can be used to position the mobile pulley 28 along the guide pole 17 at the preferred height.

The present invention further comprises a control housing 10 that is used to hold the processing unit 2. Other electronic components such as display screens can also be mounted onto the control housing 10. The control housing 10 is connected to a terminal end 5 of the first lateral edge 3 and the second lateral edge 4. The terminal end 5 is positioned adjacent to the distal end 27 the first guide channel 23 and the distal end 27 of the second guide channel 24. Therefore, the use of the control housing 10 is not hindered by the first weight-engaging pulley mechanism 13 or the second-weight engaging pulley mechanism that move along the first guide channel 23 and the second guide channel 24 respectively.

In existing treadmills, the treadmill belt track 6 can be adjusted only to simulate an incline. Even though using the incline can be extremely beneficial in a training perspective, the inability to simulate a decline can be disadvantageous. As an example, if the user intends on simulating different elevations during the workout, the inability to simulate the decline can be disadvantageous. To address the issue, the treadmill 1 further comprises an incline-adjustment mechanism 7. The processing unit 2 and the incline-adjustment mechanism 7 are electronically connected to each other so that the user can vary the incline as preferred via the processing unit 2. For the treadmill belt track 6 to adjust per user preference, the incline-adjustment mechanism 7 is mechanically integrated into the treadmill belt track 6.

Another issue with existing treadmills is the one-directional movement of the treadmill belt. More specifically, the treadmill belt only allows the user to run or walk in a forward direction. Therefore, if the user intends to train running backwards or walking backwards, the user is forced to turn backwards. To address the issue, the treadmill 1 of the present invention comprises a belt 8 and the present invention comprises a belt direction-reversing mechanism 9. The belt 8 is layered along the treadmill belt track 6. For the user to control the direction of the belt 8, the belt direction-reversing mechanism 9 is electronically connected to the processing unit 2. When the instructions are received through the processing unit 2, the belt direction-receiving mechanism 9 adjusts the direction of the belt 8 accordingly. To do so, the belt is mechanically engaged with the belt-direction reversing mechanism 9.

Ensuring user safety is vital when designing training equipment. To aid the user during the workout, the treadmill further comprises a first retractable arm 11 and a second retractable arm 12. The first retractable arm 11 and the second retractable arm 12 are perpendicularly connected to the control housing 10 so that the user can promptly grasp the first retractable arm 11 and the second retractable arm 12 when additional support is needed. The retractability is especially important so that the operational range of the first weight-engaging pulley mechanism 13 and the operational range of the second weight-engaging pulley mechanism 14 is not hindered.

Figure 7:
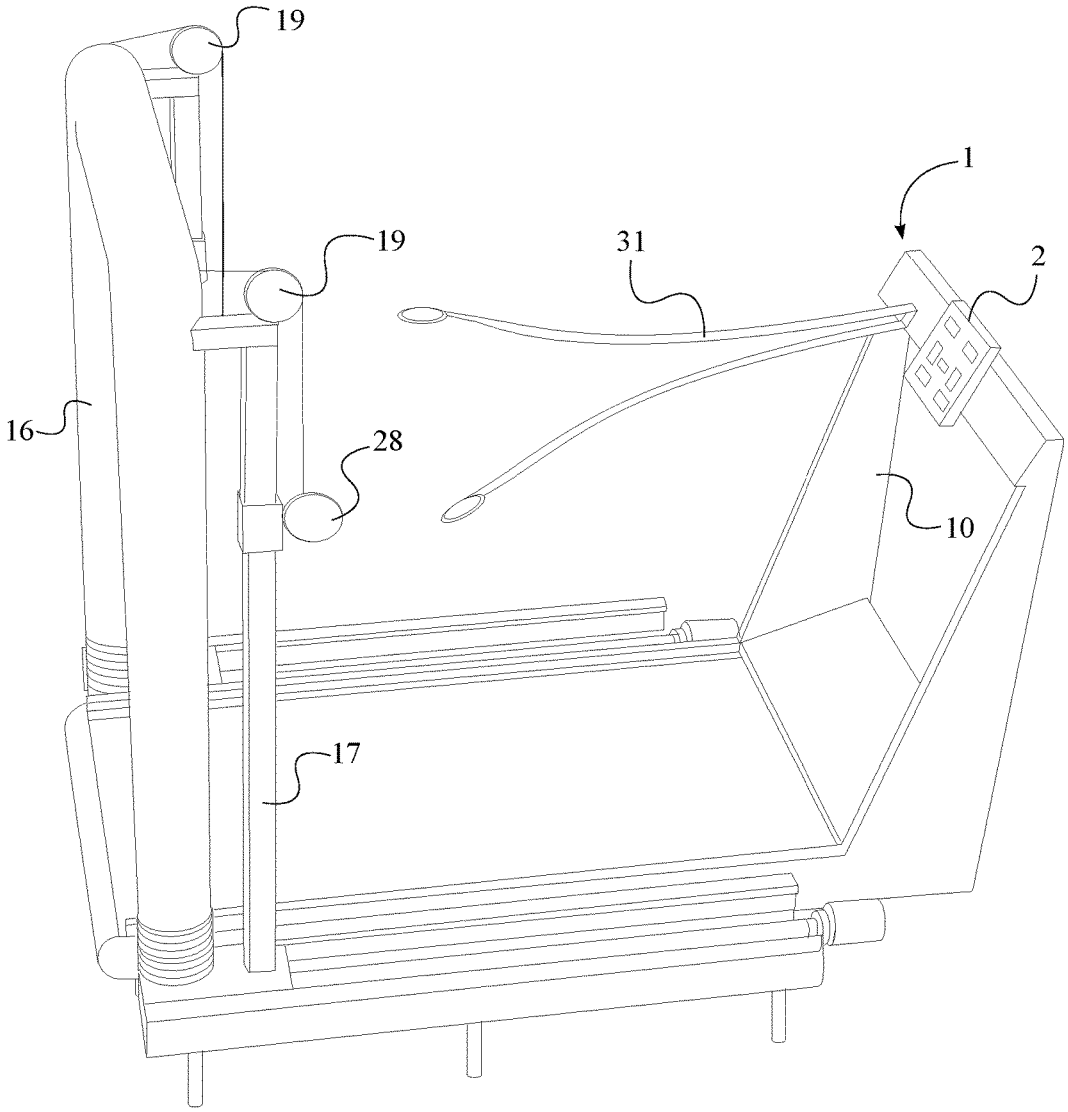
FIG. 7 is a perspective view of the present invention, wherein the safety harness is illustrated.

As an additional safety measure, the present invention further comprises a safety harness 31 as illustrated in FIG. 7. The safety harness 31 is removably attached to the treadmill 1. When needed, the safety harness 31 is strapped around the body. When additional support is not needed, the safety harness 31 is detached from the treadmill 1.

The present invention further comprises an emergency stop mechanism that is integrated into the treadmill 1. The emergency stop mechanism can vary in different embodiments of the present invention. In one embodiment of the present invention the emergency stop mechanism can be a magnetic attachment. In such instances, one end is magnetically attached to the treadmill 1 and an opposite end is clipped onto the user. Therefore, if the user loses balance on the treadmill 1, the magnetic attachment detaches from the treadmill 1 and thereby stopping the movement of the belt.

The following process flow is generally followed when utilizing the present invention. As an example, consider the user completing a cardiovascular workout with the present invention. The user initially steps on the belt 8. By utilizing the processing unit 2, settings such as the speed, incline, direction of movement, and time are set by the user. The treadmill 1 is oriented to be at an incline or decline with the use of the incline-adjustment mechanism 7. The direction of the belt 8 is adjusted to move forward or backwards with the belt direction-reversing mechanism 9. If the user needs additional support, when walking or running on the belt 8, the first retractable arm 11 and the second retractable arm 12 is used. If additional safety is required, the safety harness 31 is used when walking or running on the treadmill 1.

If the user intends on completing a strength training workout while utilizing the treadmill or independently, the first weight-engaging pulley mechanism 13 and/or the second weight-engaging pulley mechanism 14 is used. The cable 22 is used to control the set of weights 18. Different attachments such as a barbell, a rope, or a handle can be used in the process of controlling the set of weights 18 via the cable 22. The mobile pulley 28 allows the user to position the cable 22 at a preferred position per the workout. As an example, if an overhead triceps workout is performed, the mobile pulley 28 will be positioned at a higher position on the guide pole 17. On the other hand, if a cable 22 biceps cable curl is performed, the cable 22 will be positioned at a lower position on the guide pole 17.

As discussed earlier, the effective design of the present invention allows the user to perform strength training exercises while walking or jogging on the treadmill 1. As an example, the user can complete a weighted walking lunges exercise with the use of the present invention. The ability to move the set of weights 18 to different positions along the treadmill 1 increases the number of workouts that can be executed with the present invention.

By utilizing the present invention, the time required to complete a given workout routine is significantly reduced. On the other hand, the limited space requirement allows the user to utilize the present invention as a household item.

Although the invention has been explained in relation to its preferred embodiment, it is to be understood that many other possible modifications and variations can be made without departing from the spirit and scope of the invention as hereinafter claimed.

What is claimed is:

1. A cross-training treadmill comprises:

a treadmill;

a first weight-engaging pulley mechanism;

a second weight-engaging pulley mechanism;

a first guide channel;

a second guide channel;

a power source;

the treadmill comprises a processing unit, a first lateral edge, a treadmill belt track, and a second lateral edge;

the first weight-engaging pulley mechanism and the second weight-engaging pulley mechanism each comprise a slidable base;

the treadmill belt track being positioned in between the first lateral edge and the second lateral edge;

the first guide channel being positioned adjacent the first lateral edge;

the second guide channel being positioned adjacent the second lateral edge;

the slidable base of the first weight-engaging mechanism being slidably positioned along the first guide channel;

the slidable base of the second weight-engaging pulley mechanism being slidably positioned along the second guide channel;

the power source being electrically connected to the processing unit;

the treadmill further comprises a control housing;

the first guide channel and the second guide channel each comprise a proximal end, a channel body, and a distal end;

the first lateral edge and the second lateral edge each comprise a terminal end;

the channel body extending from the proximal end to the distal end;

the terminal end of the first lateral edge being positioned adjacent the distal end of the first guide channel;

the terminal end of the second lateral edge being positioned adjacent the distal end of the second guide channel; and the control housing being connected to the terminal ends.

2. The cross-training treadmill as claimed in claim 1 further comprises:

the treadmill further comprises an incline-adjustment mechanism;

the processing unit and the incline-adjustment mechanism being electronically connected to each other; and the incline-adjustment mechanism being mechanically engaged with the treadmill belt track.

3. The cross-training treadmill as claimed in claim 1 further comprises:

the treadmill further comprises a belt;

a belt direction-reversing mechanism;

the belt being layered along the treadmill belt track;

the belt direction-reversing mechanism being electronically connected to the processing unit; and the belt being mechanically engaged with the belt direction-reversing mechanism.

4. The cross-training treadmill as claimed in claim 1 further comprises:

the first weight-engaging pulley mechanism and the second weight-engaging pulley mechanism each further comprise a holding column, a guide pole, a set of weights, a first pulley, a second pulley, a motor, and a cable;

the guide pole being positioned adjacent and parallel to the holding column;

the holding column and the guide pole being perpendicularly connected to the slidable base;

the set of weights being slidably positioned within the holding column;

the first pulley being terminally connected to the guide pole opposite to the slidable base;

the second pulley being connected to the holding column adjacent to the first pulley and opposite to the slidable base;

the cable being terminally attached to the set of weights;

the cable being mechanically engaged with the first pulley and the second pulley; and the processing unit being electronically connected to the motor.

5. The cross-training treadmill as claimed in claim 4 further comprises:

the first guide channel and the second guide channel each comprise a proximal end, a channel body, and a distal end;

the channel body extending from the proximal end to the distal end; and the motor being terminally connected to the distal end.

6. The cross-training treadmill as claimed in claim 4 further comprises:

a mobile pulley; and the mobile pulley being slidably connected along the guide pole.

7. The cross-training treadmill as claimed in claim 4 further comprises:

a plurality of height-adjustment markers; and the plurality of height-adjustment markers being distributed along the guide pole.

8. The cross-training treadmill as claimed in claim 4 further comprises:

a stabilizing arm;

the stabilizing arm being connected to the channel body opposite the holding column and the guide pole; and the stabilizing arm extending from the slidable base of the first weight-engaging pulley mechanism to the slidable base of the second weight-engaging pulley mechanism.

9. The cross-training treadmill as claimed in claim 4 further comprises:

a rubber damper;

the rubber damper being positioned within the holding column; and the rubber damper being pressed against the slidable base.

10. The cross-training treadmill as claimed in claim 9 further comprises:

the treadmill further comprises a first retractable arm and a second retractable arm; and the first retractable arm and the second retractable arm being perpendicularly connected to the control housing.

11. The cross-training treadmill as claimed in claim 1 further comprises:

a safety harness; and the safety harness being removably attached to the treadmill.

12. The cross-training treadmill as claimed in claim 1, wherein an emergency stop mechanism is integrated into the treadmill.

* * * * *